US008776310B2

(12) United States Patent
Genn et al.

(10) Patent No.: US 8,776,310 B2
(45) Date of Patent: Jul. 15, 2014

(54) CLEANER-HEAD FOR A VACUUM CLEANER

(71) Applicant: Dyson Technology Limited, Wiltshire (GB)

(72) Inventors: Stuart Lloyd Genn, Malmesbury (GB); Christopher Lesniowski, Malmesbury (GB); Stephen Benjamin Courtney, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 13/761,990

(22) Filed: Feb. 7, 2013

(65) Prior Publication Data

US 2013/0212832 A1 Aug. 22, 2013

(30) Foreign Application Priority Data

Feb. 8, 2012 (GB) ..... 1202178.8

(51) Int. Cl.
*A47L 5/28* (2006.01)

(52) U.S. Cl.
USPC ..... 15/375; 15/376; 15/377; 15/391; 15/383; 15/413

(58) Field of Classification Search
USPC ..... 15/375, 376, 377, 389–392, 383, 413
IPC ..... A47L 5/28
See application file for complete search history.

(56) References Cited

U.S. PATENT DOCUMENTS

| | | | |
|---|---|---|---|
| 1,638,797 | A | 8/1927 | Claus |
| 1,914,834 | A | 6/1933 | Otto |
| 5,465,451 | A | 11/1995 | Stegens |
| 6,134,745 | A | 10/2000 | Woerwag |
| 6,323,570 | B1 | 11/2001 | Nishimura et al. |
| 2005/0160555 | A1 | 7/2005 | Mayes |
| 2011/0303239 | A1 | 12/2011 | Harrison et al. |
| 2013/0174373 | A1 | 7/2013 | Genn et al. |
| 2013/0205539 | A1 | 8/2013 | Dyson et al. |

FOREIGN PATENT DOCUMENTS

| | | |
|---|---|---|
| DE | 197 06 239 | 4/1998 |
| DE | 198 05 900 | 7/1999 |
| EP | 1 371 317 | 12/2003 |
| GB | 2478386 | 9/2011 |

(Continued)

OTHER PUBLICATIONS

Search Report dated May 28, 2012, directed towards GB Application No. 1202178.8; 1 page.

(Continued)

*Primary Examiner* — David Redding
(74) *Attorney, Agent, or Firm* — Morrison & Foerster LLP

(57) ABSTRACT

A cleaner head for a vacuum cleaner has a dirty-air inlet provided in a main suction chamber of the cleaner head, an outlet duct extending from the main suction chamber for connection to a suction source, and a rotating brush bar housed inside the main suction chamber for agitating a floor surface contacted through the dirty-air inlet. The brush bar is driven by an air-cooled motor housed inside a hollow section of the brush bar, the motor having an air intake and an air exhaust fluidly connected to one another to form an air cooling path through the inside of the motor. The air intake is connected to a clean air inlet on the cleaner head and the air exhaust is fluidly connected to the outlet duct by an exhaust duct which bypasses the main suction chamber.

3 Claims, 6 Drawing Sheets

(56) References Cited

FOREIGN PATENT DOCUMENTS

| | | |
|---|---|---|
| JP | 11-42184 | 2/1999 |
| JP | 2000-245662 | 9/2000 |
| JP | 2010-131456 | 6/2010 |

OTHER PUBLICATIONS

International Search Report and Written Opinion dated Mar. 27, 2013, directed to International Application No. PCT/GB2013/050010; 7 pages.

Genn et al., U.S. Office Action mailed Oct. 2, 2013, directed to U.S. Appl. No. 13/738,488; 6 pages.

CLEANER-HEAD FOR A VACUUM CLEANER

REFERENCE TO RELATED APPLICATIONS

This application claims the priority of United Kingdom Application No. 1202178.8, filed Feb. 8, 2012, the entire contents of which are incorporated herein by reference.

FIELD OF THE INVENTION

The present invention relates to the field of vacuum cleaners, and in particular to a cleaner head for a vacuum cleaner.

The invention is concerned specifically with cleaner heads which incorporate a motor-driven agitator. The vacuum cleaner, on the other hand, may be of any general type. For example, the cleaner head may be a fixed cleaner head on an upright vacuum cleaner, or alternatively it may be the cleaner head of a floor tool used with a cylinder vacuum cleaner or stick-vac cleaner. The invention is not limited to cyclonic vacuum cleaners.

BACKGROUND OF THE INVENTION

It is conventional to provide the cleaner head of a vacuum cleaner with an agitator, such as a rotating brush bar, for agitating or "beating" a floor surface—particularly carpet—to improve pick-up performance.

Although the main vac-motor on the cleaner can be used to drive this agitator, it is more common to use a separate, dedicated motor to drive the agitator. This separate motor can then be positioned close to the agitator—usually somewhere on the cleaner head itself—to simplify the transmission arrangement.

In a particularly compact sort of arrangement, the motor is actually housed inside the agitator, which usually takes the form of a hollow cylindrical brush bar. This sort of layout is described in U.S. Pat. No. 6,323,570.

Housing the motor—or part of the motor—within the restricted space inside the agitator makes the motor prone to overheating. Typically therefore, these "motor-in-brushbar" arrangements will incorporate some sort of air-cooling scheme for drawing clean—not dirty—air through the inside of the brush bar to cool the motor.

SUMMARY OF THE INVENTION

It is an aspect of the present invention to provide an improved "motor-in-brushbar" type cleaner head, in particular by trying to improve the air-cooling scheme for the motor.

According to the present invention, there is provided a cleaner head having a dirty-air inlet provided in a main suction chamber of the cleaner head, an outlet duct extending from the main suction chamber for connection to a suction source, and a rotating brush bar housed inside the main suction chamber for agitating a floor surface contacted through the dirty-air inlet, the brush bar being driven by an air-cooled motor housed inside a hollow section of the brush bar, the motor having an air intake and an air exhaust fluidly connected to one another to form an air cooling path through the inside of the motor, wherein the air intake is connected to a clean air inlet on the cleaner head and the air exhaust is fluidly connected to the outlet duct by an exhaust duct which bypasses the main suction chamber.

In the arrangement described in U.S. Pat. No. 6,323,570, the cooling air exhausted from the motor subsequently passes through the main suction chamber. This creates competing design considerations: on the one hand, it is preferable that the dirty air inlet is large—to maximise the active footprint of the cleaner head in use—and also that the clean air inlet is small—to reduce problems with dirt ingress into the motor; but on the other hand, if the dirty-air inlet has a significantly larger cross section that the clean air inlet then there will be a proportional reduction in the flow rate of cooling air through the motor if the cleaner head is lifted off the ground in use, because the vast proportion of the available flow generated by the common suction source will be drawn in through the large, unrestricted dirty air inlet and not the relatively small clean air inlet.

The present invention addresses this problem, effectively by connecting the clean air inlet and dirty air inlet to the outlet duct in parallel. This sort of arrangement utilises the outlet duct as a flow restriction to limit the proportion of the available flow drawn in through the dirty-air inlet, so that a greater proportion of the available flow is instead drawn in through the clean air inlet. The outlet duct presents a fixed flow restriction which acts to limit flow through the dirty air inlet even when the dirty air inlet is completely unrestricted. So the beneficial flow-balancing effect is achieved without reducing the area of the dirty-air inlet, nor increasing the area of the clean air inlet.

The invention is not limited to any particular type of motor. The brush bar may be 'indirect-drive'—being driven via some sort of transmission—or 'direct-drive'. In an indirect-drive arrangement, the transmission may be an epicyclic gearing arrangement, but this is not essential.

BRIEF DESCRIPTION OF THE DRAWINGS

Embodiments of the invention will now be described, by way of example, with reference to the accompanying drawings, in which.

DETAILED DESCRIPTION OF THE INVENTION

Figure 1:
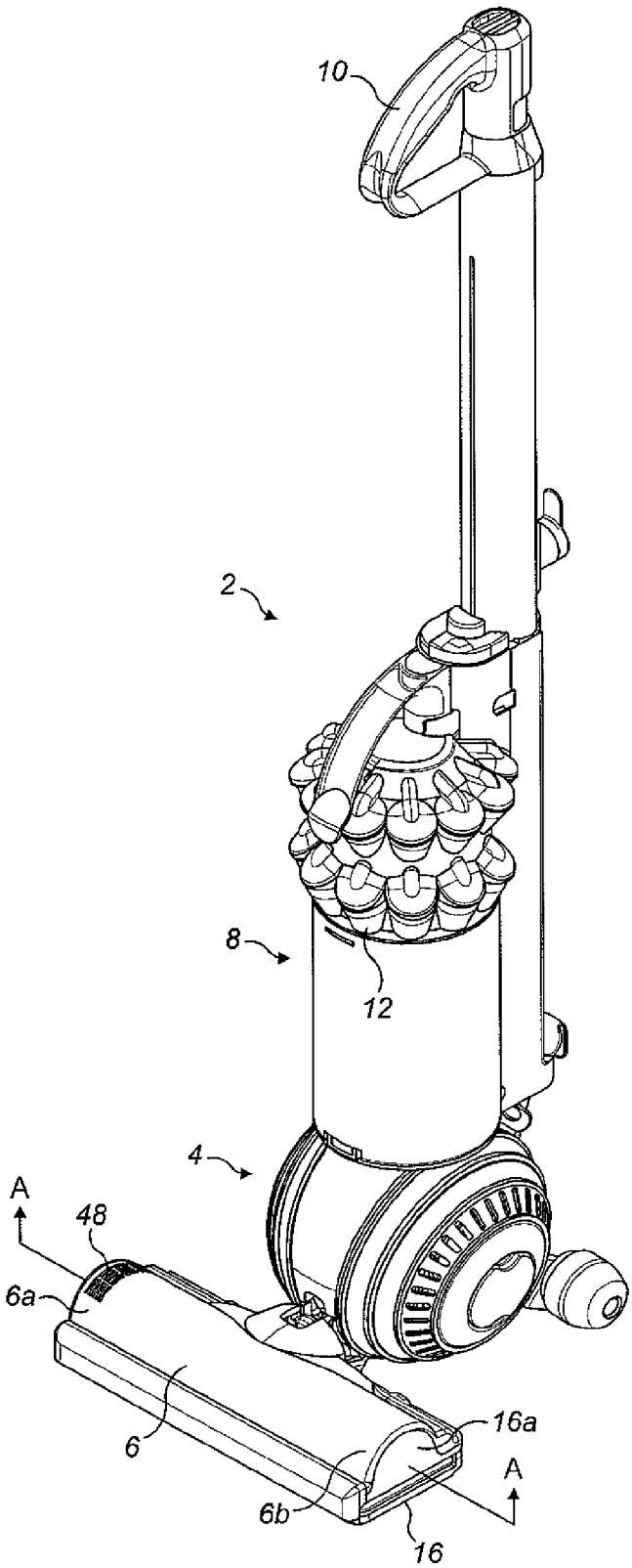
FIG. 1 is a perspective view of a vacuum cleaner having a cleaner head in accordance with the present invention.

FIG. 1 shows an upright vacuum cleaner 2. The cleaner 2 has a rolling head assembly 4 which carries a fixed cleaner head 6, and an 'upright' body 8 which can be reclined relative to the head assembly 4 and which includes a handle 10 for manouevring the cleaner 2 across the floor. In use, a user grasps the handle 10 and reclines the upright body 8 until the handle 10 is disposed at a convenient height for the user; the user can then roll the vacuum cleaner 2 across the floor using the handle 10 in order to pick up dust and other debris on the floor.

The vacuum cleaner 2 picks up the dirt and debris by entraining it in a "dirty" airflow, which is sucked in through the cleaner head 6 by a vac-motor onboard the cleaner 2. This dirty airflow is then ducted—under the suction pressure generated by the vac-motor—to a cyclonic separating apparatus 12, where dirt is separated from the air before the relatively clean air is then exhausted back to the atmosphere.

Figure 3:
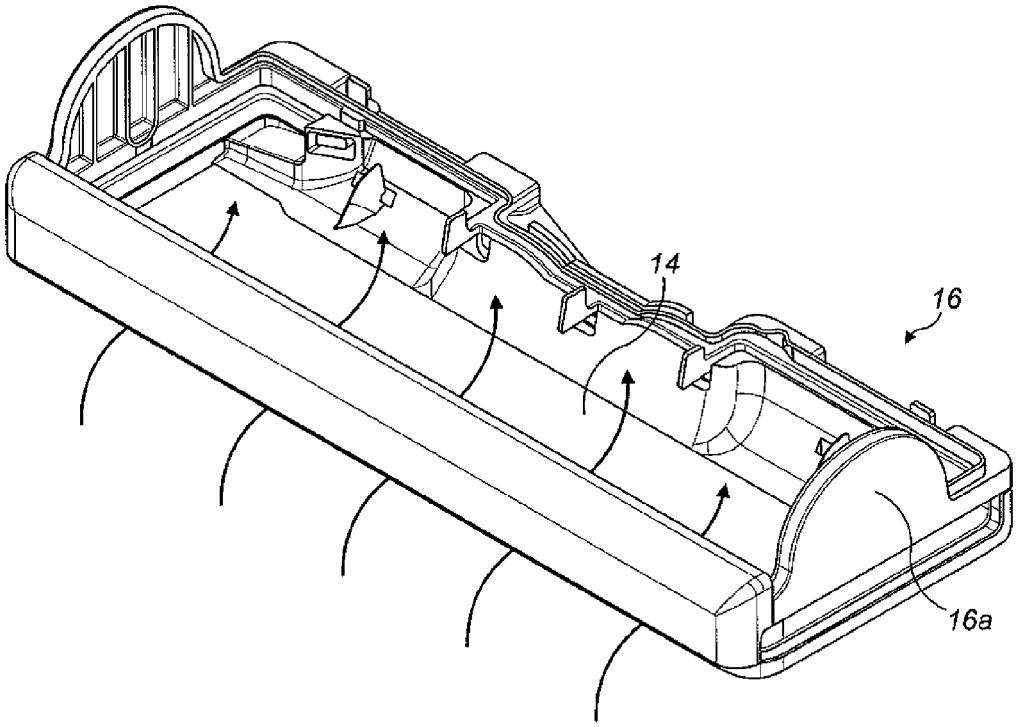
FIG. 3 is a perspective view of a removable soleplate, forming part of the cleaner head.

The dirty air enters the cleaner head 6 through a dirty air inlet. This dirty air inlet is in the form of a relatively large suction opening 14 which is provided on a removable soleplate 16, shown in FIG. 3.

Figure 4:
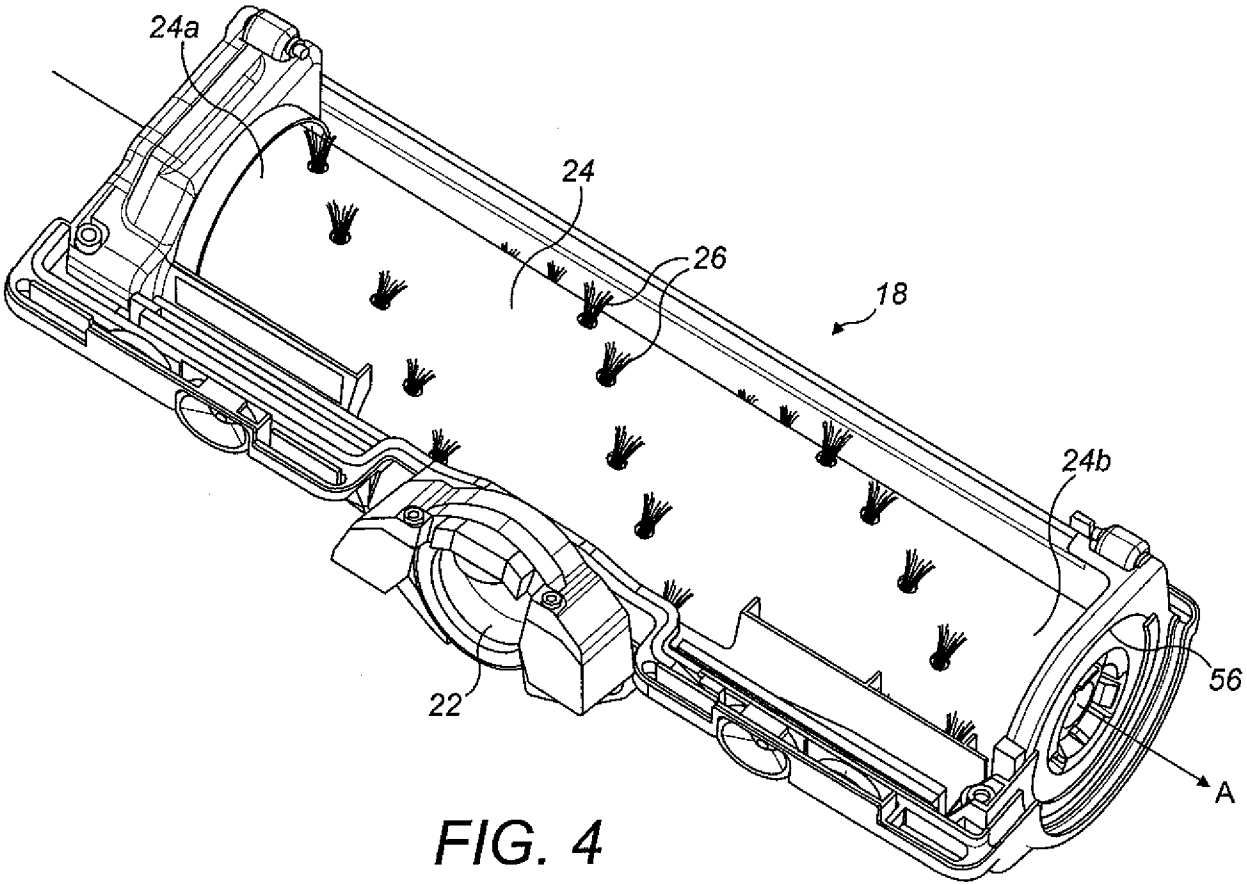
FIG. 4 is a perspective view from the underside of a brush bar housing, forming part of the cleaner head.

The soleplate 16 fits onto the bottom of a brush-bar housing 18, shown from the underside in FIG. 4, to form a main suction chamber 20 inside the cleaner head 6. An outlet duct 22 for the main suction chamber 20 (FIG. 2) is provided in the rear of the brush-bar housing 18. The dirty air passing through the suction opening 14 (the airflow is illustrated by the arrows in FIG. 3), enters the main suction chamber 20 and then exits the cleaner head 6 via the outlet duct 22, which connects to upstream ducting on the cleaner 2 for passage to the cyclonic separating apparatus 12.

An agitator in the form of a hollow, cylindrical brush bar 24 is mounted inside the main suction chamber 20, alongside the suction opening 14, for rotation about an axis A. The brush bar 24 is oriented lengthways along the axis A (FIG. 4), with a first end 24*a* of the brush bar 24 near a respective first end 6*a* of the cleaner head 6 and a second end 24*b* of the brush bar 24 near the respective second end 6*b* of the cleaner head 6.

The brush bar 24 is intended primarily to improve "pick up" on carpeted surfaces. In use, the bristles 26 on the brush bar 24 reach through the suction opening 14 in the soleplate 16 to penetrate the carpet fibres, and the agitating action of the brush bar 24 as it rotates helps dislodge stubborn dirt clinging to the carpet fibres. This dislodged dirt is more easily entrained in the airflow drawn into the cleaner head 6 through the suction opening 16.

Figure 2:
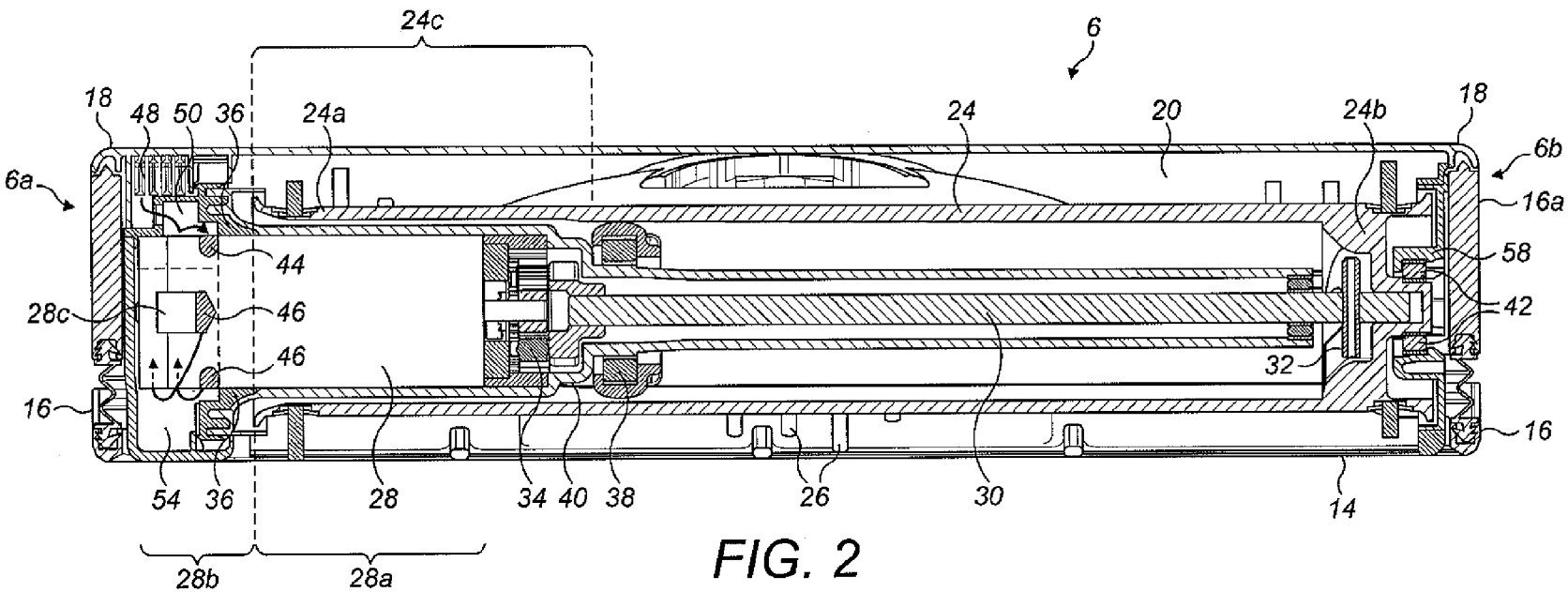
FIG. 2 is a part-sectional view of the cleaner head, taken along the line A-A in FIG. 1.

The rotating brush bar 24 is shaft-driven by a brushed motor 28, arranged co-axially with the brush bar 24 at the first end 6*a* of the cleaner head 6, as shown in FIG. 2. The motor torque is transmitted via an internal drive shaft 30 which extends through the hollow brush bar 24. This drive-shaft 30 engages the second end 24*b* of the brush bar 24 axially from the inside via a drive dog 32, which keys axially into a respective keyway (not visible in the drawings) in the end of the brush bar 24. To save space, the motor 28 itself is also housed partly inside the hollow brush bar 24: so, a first section 28*a* of the motor 28 is housed inside a hollow end section 24*c* of the brush bar 24, and a second section 28*b* of the motor 28—which in this case includes the carbon brushes 28*c* (only one of which is visible in FIG. 2)—extends out through the first end 24*a* of the brush bar 24. Mains (or battery) power is supplied to the motor 28 via the carbon brushes 28*c*, externally of the brush bar 24.

Torque transmission is via an epicyclic gearbox 34, in this case located immediately inboard of the motor 28, inside the brush bar 24.

The motor 28, gearbox 34 and drive shaft 30 are cantilevered through the first end 24*a* of the brush bar 24 by a motor mounting assembly 36 which is fixed at the first end 6*a* of the cleaner head 6.

The hollow end section 24*c* of the brush bar 24 is maintained in clearance around the motor 28 and the gearbox 34 via a first bearing 38. This first bearing 38 is positioned immediately in-board of the gearbox 34 on a protective housing 40 which helps prevent ingress of dust to the motor 28 and gearbox 34. A second bearing 42 supports the second end 24*b* of the brush bar 24.

Figure 5:
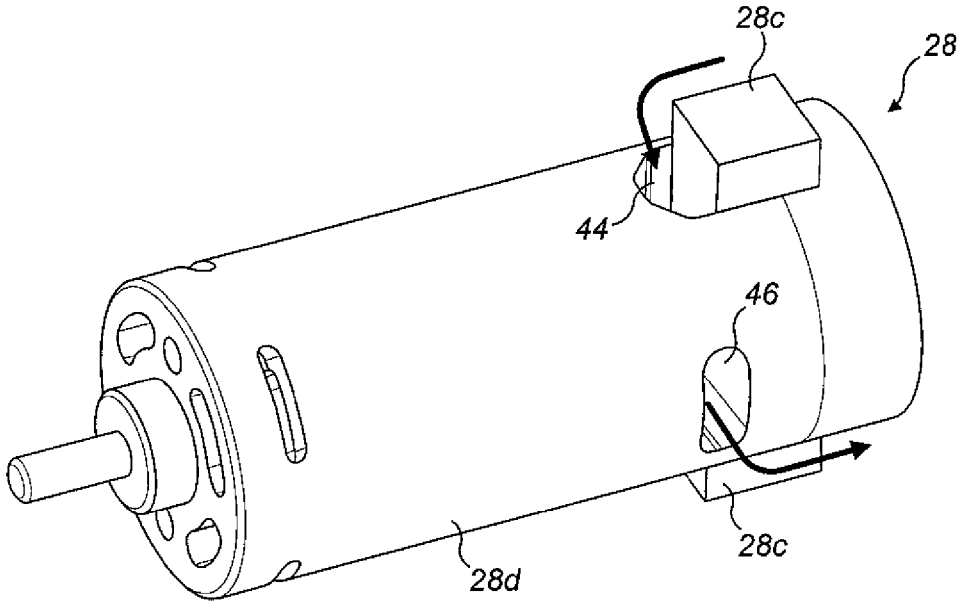
FIG. 5 is a perspective view of a motor, illustrating the position of cooling holes on the motor casing.
Figure 6:
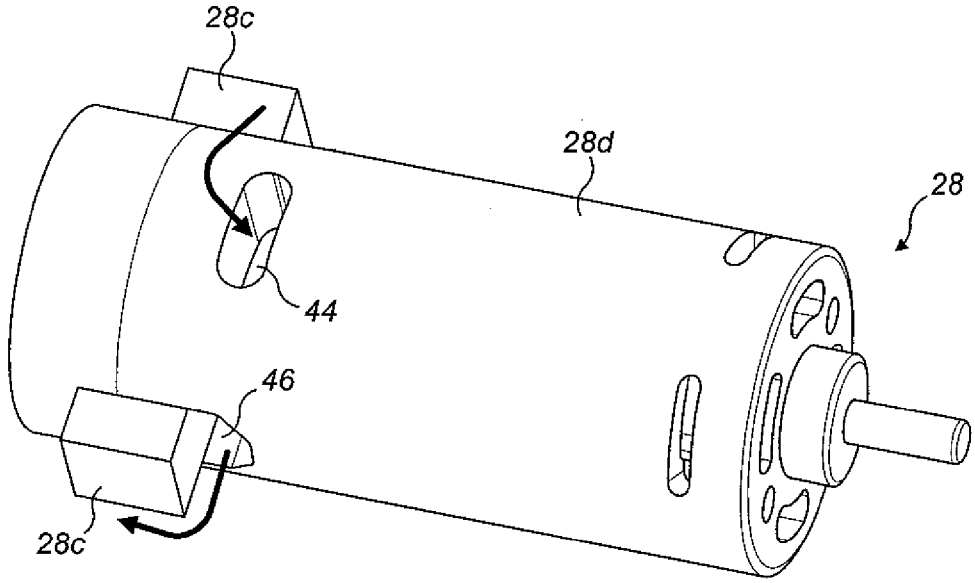
FIG. 6 is a reverse perspective view of the motor shown in FIG. 5.

The motor 28 is air-cooled in use to prevent it from overheating. Cooling holes are provided on the motor casing 28*d* for this purpose: in this case two air intakes 44 and two air exhausts 46 (see FIGS. 5 and 6), though more or fewer cooling holes may be provided, as required, provided that there is at least one intake and one exhaust (the motor 28 is not sectioned in FIG. 2, so that the casing 28*d* and cooling holes 44, 46 are visible). The cooling holes are connected—intake to exhaust—to provide an internal air-cooling path through the motor 28.

The air intakes 44 are each connected to a clean air inlet 48 provided on top of the cleaner head (see FIG. 1) by a stationary intake duct, or passageway, 50.

Figure 7:
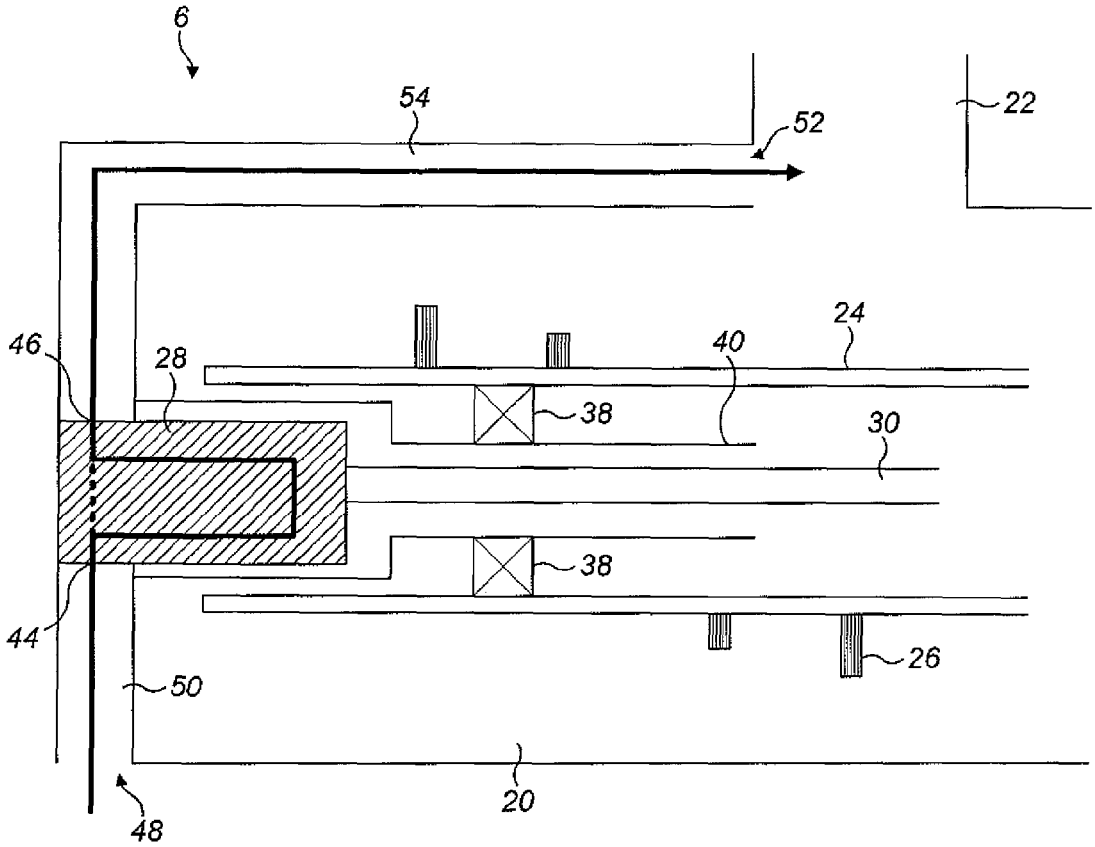
FIG. 7 is a schematic diagram illustrating part of the cleaner head.

The air exhausts 46 are each connected to a clean air outlet 52 in the wall of the outlet duct 22 by a stationary exhaust duct, or passageway 54. This passageway 54 bypasses the main suction chamber 20 so that there is no mixing of the clean and dirty air inside the main suction chamber 20. This passageway 54 is shown in FIG. 7, which is a schematic representation of the cleaner head 6.

In use, the main vac motor generates a negative pressure at the clean air outlet 52, which draws clean air in through the clean air inlet 48. This clean air is pulled in through the air intakes 44 on the motor casing 28*d* via the stationary intake duct 50 and is circulated through the motor 28 to the air exhausts 46, cooling the motor 28. The exhausted waste air then passes via the stationary exhaust duct 54 to the clean air outlet 52, where it passes into the outlet duct 22 and combines with the dirty air from the main suction chamber 20.

The cleaner head 6 may be lifted off the floor in use. In certain cases, it may be lifted off the floor for a considerable period of time before the brush bar motor 28 is de-energised, or before the cleaner head 6 is placed back in contact with the floor. When the cleaner head 6 is not in contact with the floor, the outlet duct 22 acts as a restriction on the dirty airflow through the suction opening 14: effectively limiting the proportion of the available airflow which is drawn in through the suction opening 14. By appropriately sizing the outlet duct 22, the flow rate of cooling air through the brush bar motor 28 can be 'tuned' accordingly to ensure that under conditions of maximum flow through the suction opening 14—such as when the cleaner head 6 is lifted off the floor—there is nevertheless sufficient flow of cooling air through the motor 28.

The outlet duct 22 is a fixed flow restriction and, as such, will also limit the proportion of available flow drawn in through the suction opening when the cleaner head 6 is in contact with the floor, effectively reducing the suction power developed at the suction opening. However, it is common in vacuum cleaners that the main vac-motor actually develops more air watts of suction power at the suction opening than is strictly required for adequate pick-up performance (pick-up performance also being determined by a number other factors, such as brush bar performance), and therefore the reduction in suction power at the suction opening can typically be managed within the optimal range required to maintain adequate pick-up performance. In any event, the active "footprint" of the cleaner head—corresponding to the area of the suction opening 14—is maintained.

The clean air enters and exits the motor casing 28*d* externally of the brush bar 24. This is a simple, compact and robust arrangement, which does not have the complications associated with schemes in which a hollow brush bar is actually used as an air duct to carry cooling air to the motor. Alternatively, one or both of the stationary ducts 50, 54 may extend into the brush bar 24 through the first end 24*a*.

The air cooling path inside the motor may be a circulation path which extends inside the brush bar (indicated by the bold solid arrow in FIG. 7), or it may be a "short circuit" path (indicated by the dotted line in FIG. 7). In either case, the cooling air is pulled over the carbon brushes 28*c*, which run relatively hot in use.

The invention claimed is:

1. A cleaner head for a vacuum cleaner, the cleaner head having a dirty-air inlet provided in a main suction chamber of the cleaner head, an outlet duct extending from the main suction chamber for connection to a suction source, and a rotating brush bar housed inside the main suction chamber for agitating a floor surface contacted through the dirty-air inlet, the brush bar being driven by an air-cooled motor housed inside a hollow section of the brush bar, the motor having an air intake and an air exhaust fluidly connected to one another to form an air cooling path through the inside of the motor, wherein the air intake is connected to a clean air inlet on the cleaner head and the air exhaust is fluidly connected to the outlet duct by an exhaust duct which bypasses the main suction chamber.

2. The cleaner head of claim 1, wherein a first section of the motor is located inside a hollow end section of the brush bar, and a second section of the motor extends outside the respective end of the brush bar, the air exhaust being positioned on the second section of the motor.

3. A vacuum cleaner having a cleaner head according to claim 1.

* * * * *